United States Patent [19]

Momose et al.

[11] Patent Number: 4,984,428

[45] Date of Patent: Jan. 15, 1991

[54] STIRLING ENGINE

[75] Inventors: Yutaka Momose, Anjo; Tetsumi Watanabe, Okazaki; Kouzi Hiraiwa, Toyohashi; Tomokimi Mizuno, Chiryu, all of Japan

[73] Assignee: Aisin Seiki Kabushiki Kaisha, Kariya, Japan

[21] Appl. No.: 413,731

[22] Filed: Sep. 28, 1989

[30] Foreign Application Priority Data

Sep. 29, 1988 [JP] Japan ..... 63-242412

[51] Int. Cl.[5] ..... F02G 1/04

[52] U.S. Cl. ..... 60/517

[58] Field of Search ..... 60/517

[56] References Cited

FOREIGN PATENT DOCUMENTS 58-25556 2/1983 Japan ..... 60/517

312062 10/1971 U.S.S.R. ..... 60/517

*Primary Examiner*—Allen M. Ostrager

*Attorney, Agent, or Firm*—Burns, Doane, Swecker & Mathis

[57] ABSTRACT

A stirling engine is provided in which the heater comprises an extended part of the expansion chamber as defined by an expansion cylinder. The expansion cylinder extends from the expansion chamber toward an upper side of the engine. A hollow cylindrical member receives the extended part of the expansion cylinder. The arrangement permits a stirling engine to be provided which decreases the number of parts utilized in the heater section while at the same time increasing the heat transfer area of the heater.

4 Claims, 14 Drawing Sheets

STIRLING ENGINE

BACKGROUND OF THE INVENTION

1. Field of the Invention

The present invention relates to a Stirling engine, and more particularly to the heater of the Stirling engine suitable for air-conditioning, heating and generation of electric power.

2. Description of the Related Art

A conventional Stirling engine has a reversible cycle which comprises two isothermal changes and two equivalent changes. Namely, the Stirling engine has a cycle in which cold (isothermal) compresses the operational gas such as helium enclosed therein with the external cooling (generally, the operational gas is water cooled by a cooler) and in which heat (isothermal) expands operational gas with the external heating (generally, the operational gas is heated by the combustion heat supplied to a heater). In the Stirling engine having a cycle of this sort, the waste heat left to the cooling water of the cooler is larger than 50% of the input heat supplied to the heater. By the use of the Stirling engine, it is possible to improve the efficiency of the use of the energy due to using the waste heat for heating and suctioning of hot water. Further, the heat efficiency is high, hazards to the public minimal and it is able to use a variety of fuels. As a result, the Stirling engine is suitable as the power source of the compressor for a air-conditioning and heating device.

In the Stirling engine, the efficiency of the heat transfer between the heat and the combustion gas largely influences the efficiency of the Stirling engine.

In the conventional Stirling engine, the heat-exchanger of the multi-pipe type or the bayonet type, for example, is shown by U.S. Pat. Nos. 4,069,670 and 4,719,755, respectively. In these heaters, however, since there are many parts which constitute the heater and there are many brazing points and welding points. Therefore, the number of manufacturing steps increase and the manufacturing costs increase. Further, in these heaters, scaling of the heater causes an increasing heat transfer area of the heater.

SUMMARY OF THE INVENTION

It is therefore, an object of the present invention to decrease the number of parts which constitute the heater and to improve the manufacturing operations.

It is another object of the present invention to increase the heat transfer area of the heater without causing scaling of the heater.

It is a further object of the present invention to provide an improved Stirling engine which includes an expansion chamber defined in an expansion cylinder by an expansion piston, a compression chamber defined in a compression cylinder by a compression piston and communicating with the compression chamber via a heater, a regenerator and a cooler. The heater comprises an extended part of the expansion cylinder which extends from the expansion chamber toward an upper side and a hollow cylindrical member having a bottom and an annular area which is fitted with the extending part therein, and an annular passage formed between an inner and an outer circumference of the extending part and an inner wall surface of the annular area.

BRIEF DESCRIPTION OF THE DRAWINGS

Additional objects and advantages of the present invention will become more apparent form the following detailed description of preferred embodiments thereof when considered with reference to the attached drawings, in which.

DESCRIPTION OF THE PREFERRED EMBODIMENT

Figure 1:
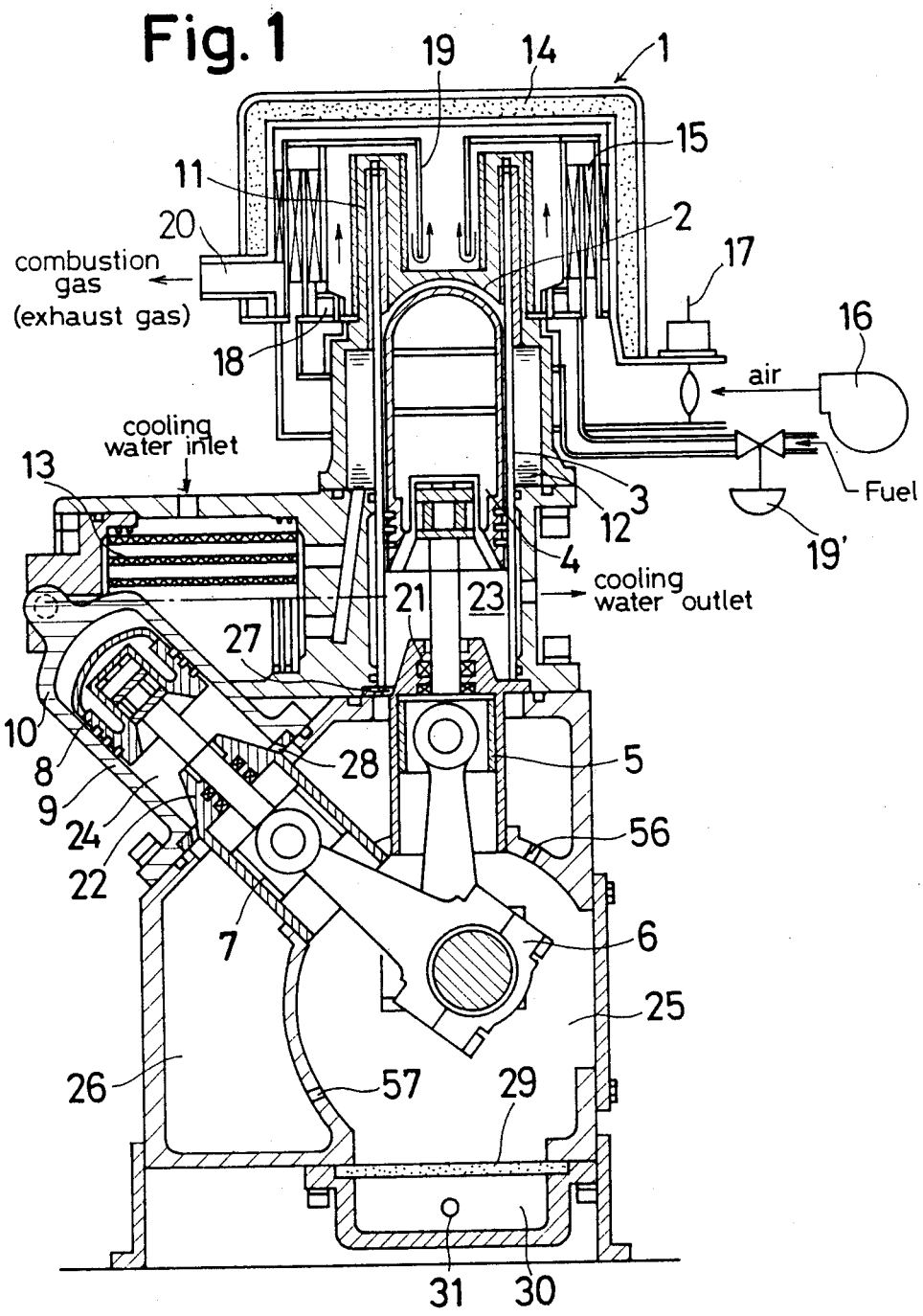
FIG. 1 is a section view of an embodiment of a Stirling engine in accordance with the present invention.

A Stirling engine constituted in accordance with embodiments of the present invention will be described with reference of the drawings.

Referring to FIG. I, there is schematically illustrated a Stirling engine which includes an expansion cylinder 3 and a compression cylinder 9 which is inclined 45 degrees with regard to the expansion cylinder 3. An expansion piston 4 is air tightly and slidably fitted into the expansion cylinder 3 which defines an expansion chamber 2 and is connected to a crankshaft 6 via a cross head 7. A compression piston 8 is air tightly and slidably fitted into the compression chamber 9 and defines a compression chamber 10 and is connected to the crankshaft 6 via a cross head 7. The expansion chamber 2 is communicated with the compression chamber 10 via a heater 11, a regenerator 12 and a cooler 13, and the operational gas, such as helium, is enclosed in the operational sealing area leading from the expansion chamber 2 to the compression chamber 10. The capacity of the expansion chamber 2 changes in response to the rotation of the crankshaft 6 and the capacity of the compression chamber 10 changes with a phase difference of 45 degrees in response to the rotation of the crankshaft 6.

A preheater 15 of air for combustion is disposed along the inner side of an isothermal outer sleeve 14. The air for combustion is supplied from a blower 16 and is introduced to the preheater 15 after the flow quantity is adjusted by a throttle valve 17. In FIG. 1, the air introduced to the preheater 15 goes through a labryinth path while being preheated and introduced to an annular ceramic burner 18. A fuel is supplied to the burner 18 via a control valve 19'. The air and fuel are burned by the burner 18. The combustion gas, having a high temperature, flows to an exhaust duct 19 while moving up and down the circumference of the heater 11 in the direction of the arrow shown in FIG. 1. At this time, heat-exchange occurs between the combustion gas and the operational gas. Afterward, the combustion gas flows along the inner circumference of the outer sleeve 14 and is discharged from an outlet port 20 via the inner part of the preheater 15.

The operational gas which is heated by the heater 11 is isothermally expanded in the expansion chamber 2. On the other hand, the operational gas from the regenerator 12 is cooled by the cooler 13 using cooling water and is isothermally compressed in the compression chamber 10.

Between each piston 4, 8 and each middle member 21, 22 supporting each piston rod, each middle chamber 23, 24 is formed therein, respectively. These middle chambers 23, 24 change their inner pressure in response to the reciprocating movement of each piston 4, 8, respectively and gives a resistance to the movement of the each piston 4,8. Therefore, in this embodiment, a buffer chamber 26 communicating with both middle chambers 23, 24 via passages 27, 28 is formed in the crank chamber 25 and the changing of pressure in the middle chambers 23, 24 is prevented.

Figure 3:
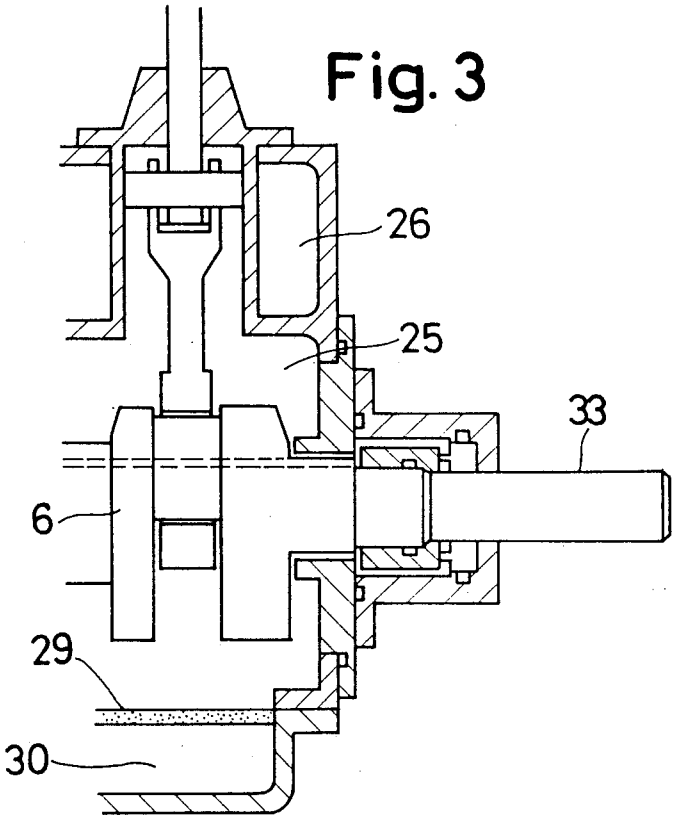
FIG. 3 is a sectional view of an output shaft of an embodiment of a Stirling engine in accordance with the present invention.
Figure 2:
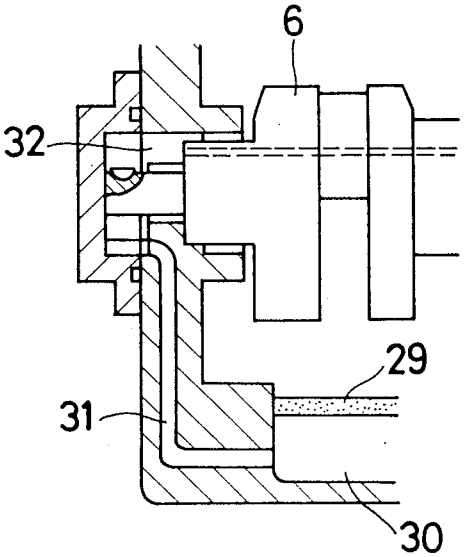
FIG. 2 is a partial section view of an oil pump of an embodiment of a Stirling engine in accordance with the present invention.

In the crank chamber 25, an oil chamber 30 is defined by an oil filter 29. The oil chamber 30 is in communication with an oil pump 32 via an oil passage 31 and the oil pump 32 supplies the oil from the oil chamber 30 to the parts which require lubrication as shown by FIG. 2 and FIG. 3.

The crankshaft 6 outputs the rotational output in response to the reciprocating movement of pistons 4, 8 and the rotational output is transmitted via an output shaft 33.

Figure 4:
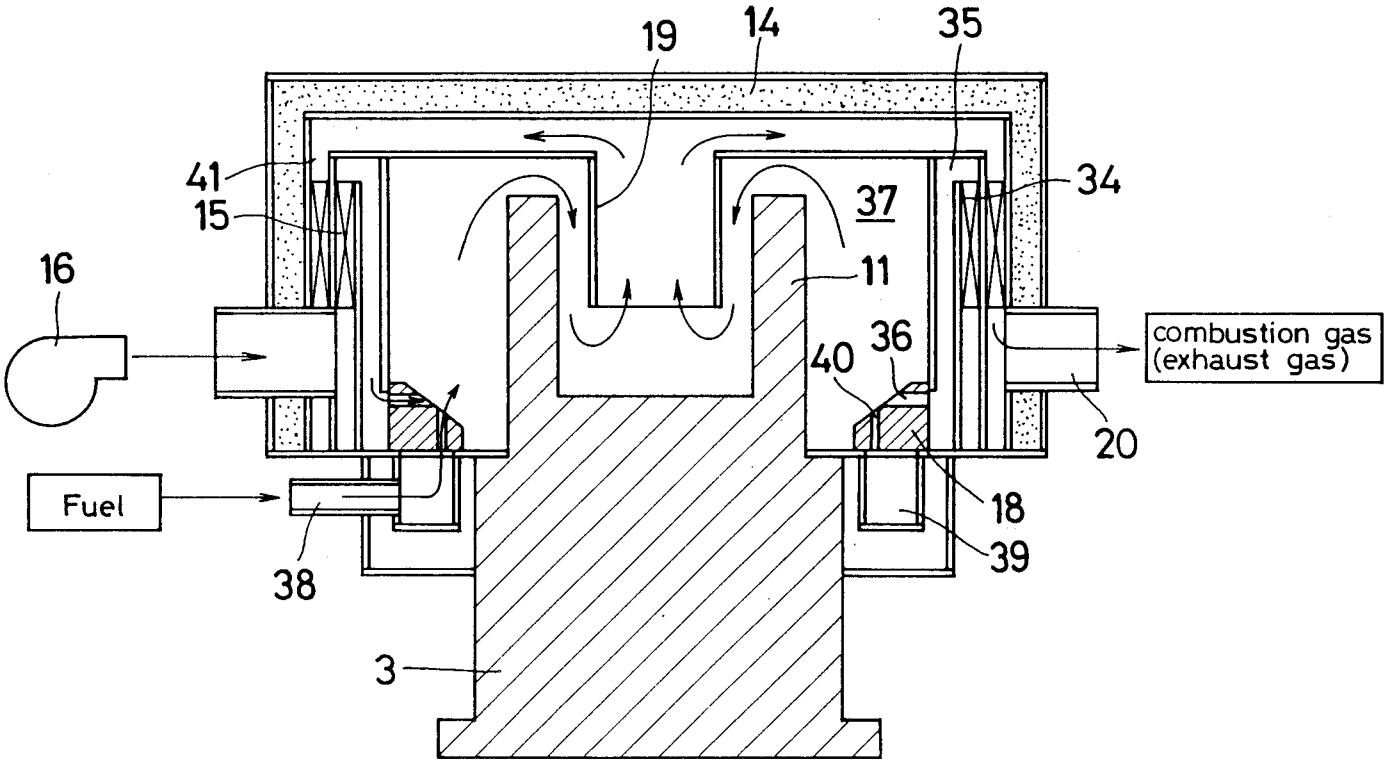
FIG. 4 is a sectional view of a combustion chamber of an embodiment of a Stirling engine in accordance with the present invention.

Referring to FIG. 4, the preheater 15 which is disposed along the inner wall of the outer sleeve 14, covered by a heat insulating material, includes a heat-exchanger 34 between the air for the combustion and the exhaust gas, an air passage 35 communicating with the burner 18 and a passage 41 for the exhaust gas. The air for the combustion which is introduced to the air passage 35 is supplied to the combustion chamber 37 via a hole or passage 36 of the burner 18. The fuel which is introduced to a delivery pipe 39 via a fuel passage 38 is introduced to the combustion chamber 37 via a hole or passage 40 of the burner 18. The fuel becomes mixed with air by the air from the hole 36 and burns outside of the heater 11. The high temperature combustion gas follows the arrow, namely, the combustion gas flows from outside of heater 11 to the inside of the heater 11. As a result, heat-exchange between the combustion gas and the operational gas is efficiently done. The combustion gas flows from the center duct 19 which extends into the center area of the heater 11, to the outside of the combustion chamber 37 and is introduced to the passage of the preheater 15. Afterwards, the combustion gas is discharged from the outlet port 20 while performing the heat-exchange with the air for the combustion.

Figure 5:
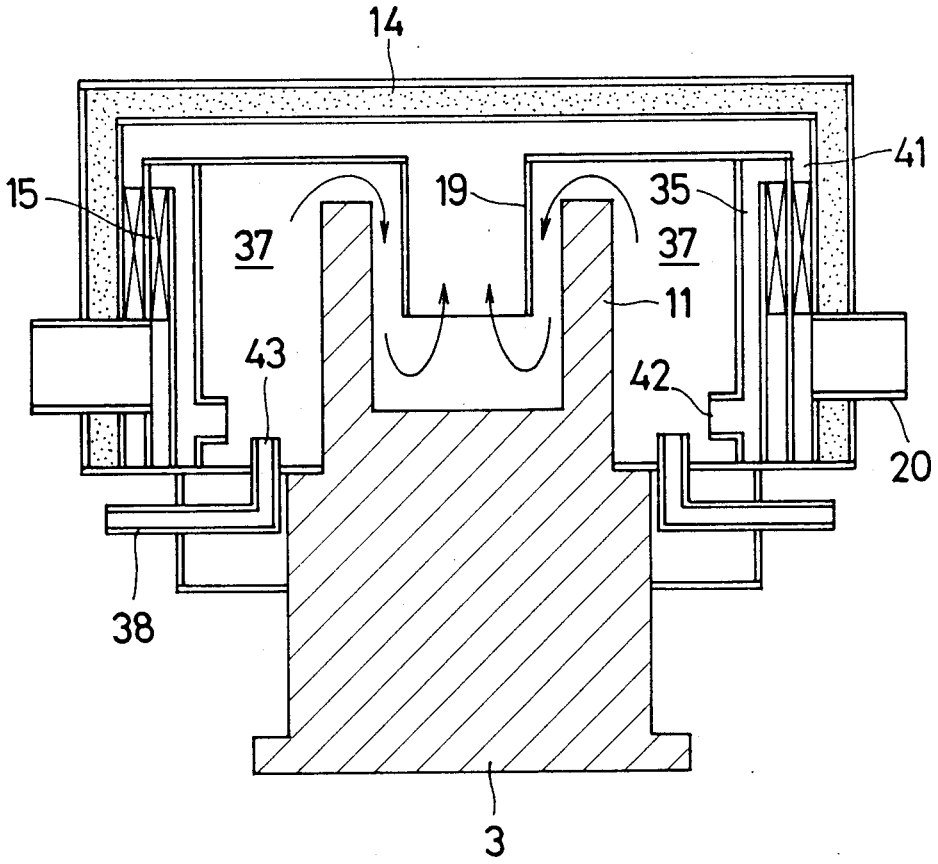
FIG. 5 and FIG. 6 are sectional views of the burners of other embodiments of a Stirling engine in accordance with the present invention.

FIG. 5 shows another embodiment of the heater. In FIG. 4, the fuel and the air for the combustion are supplied to the combustion chamber via the ceramic burner 18. On the other hand, in FIG. 5, a plurality of air supplying holes or passages 42 are formed at lower side of the air passage 35 so as to communicate with the combustion chamber 37 and a plurality of fuel delivery holes or passages 43 are provided which have a center line so as to intersect at substantially right angles to the center line of the air supplying hole 42. The fuel and air are delivered to the combustion chamber 37 via holes 42, 43, respectively. It is desirable that the air supplying holes 42 are formed to extend toward the tangent direction of the outer sleeve 14. In this embodiment, the flow of the combustion gas about the heater 11 and the heat-exchange between the heater 11 (operational gas) and the combustion gas is the same as the embodiment of FIG. 4.

Figure 6:
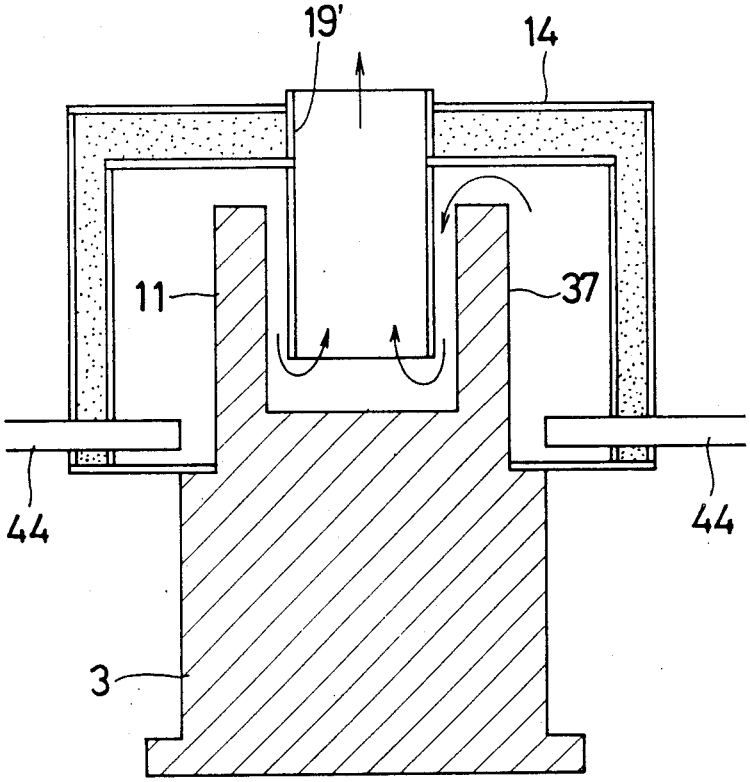

FIG. 6 shows a further embodiment of the heater. In FIG. 6, the preheater 15 is not disposed to the outer circumference of the combustion chamber 37 and the center duct 19 extends to the outside of the outer sleeve 14 via the center opening of the outer sleeve 14. The mixed air is delivered to the combustion chamber 37 via the plural pipes 44 and is burned therein. The flow of the combustion gas about the heater 11 and the heat-exchange between the heater 11 (operational gas) and the combustion gas is the same as the embodiment of FIG. 4 and FIG. 5.

The burner 18 shown by FIG. 4 is now described. The burner 18 shown in FIGS. 7–9 has an annular shape and a two piece structure which divides two parts between an upperside and a lower side. Namely, a part shown by the numeral 45 is a combination face of the upperside and lowerside. In the combination face 45 for the upper part 46 and the lower part 47, the air holes 36 are formed substantially in parallel, and the fuel delivery holes 40 extend toward the upperside and lowerside and are formed in the lower part 47. The burner 18 is provided with a tapered face 48 at its upper side of the inner circumferential surface, whereby the mixture of the fuel and the air is substantially dense.

Figure 10:
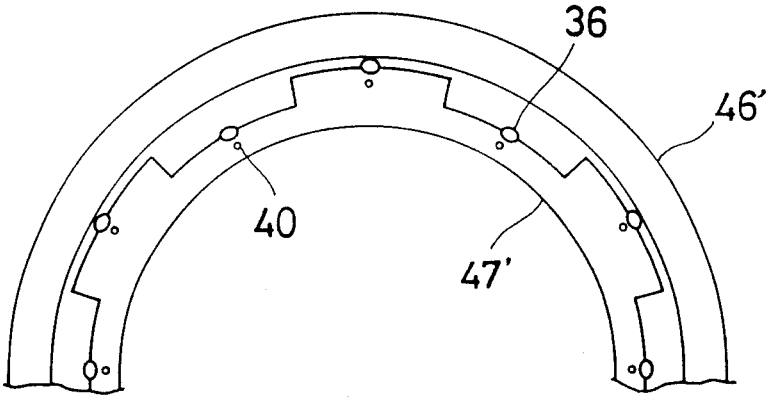
FIG. 10 is a partial plane view of a burner of another embodiment of a Stirling engine in accordance with the present invention.
Figure 11:
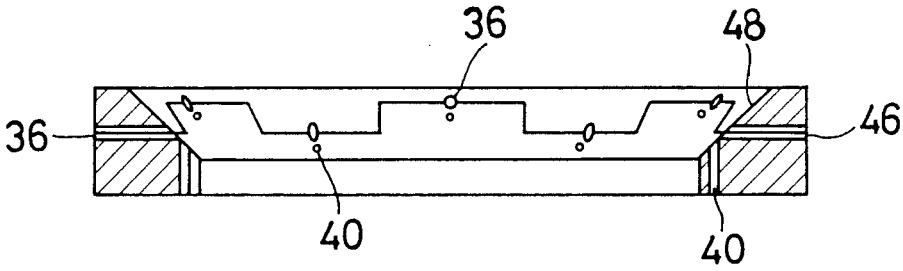
FIG. 11 is a longitudinal section view of a burner shown by FIG. 10.
Figure 12:
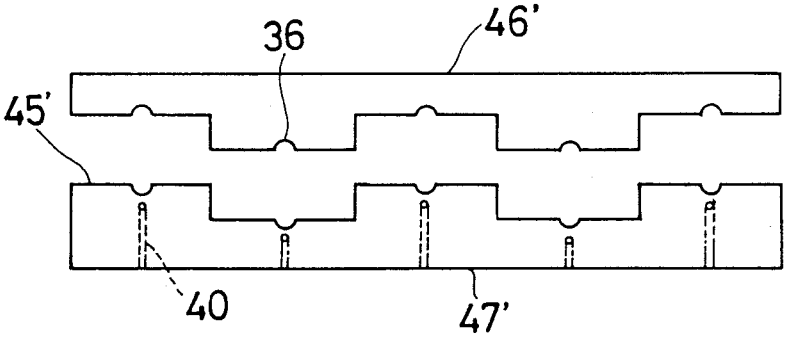
FIG. 12 is a front view of a burner shown in FIG. 10.

The embodiment shown by FIGS. 10–12 has a combination face 45' between the upper part 46' and the lower part 47' formed into step-like shape. The air holes 36 are positioned toward the upperside and lowerside so as to be next to each other as offset by the stepped shape of the combination face. Both holes 36, 40 have center lines which intersect at substantially right angles, respectively.

Figure 8:
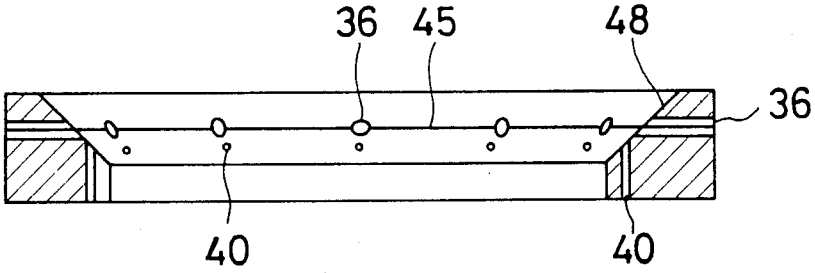
FIG. 8 is a longitudinal sectional view of a burner shown in FIG. 1.
Figure 7:
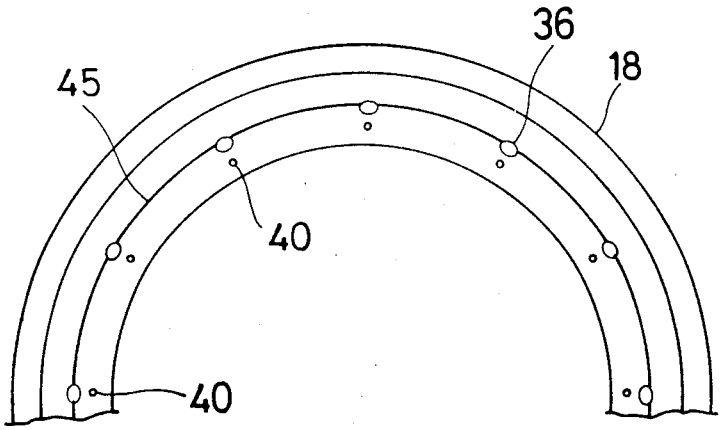
FIG. 7 is a partial plane view of a burner shown in FIG. 1.
Figure 9:
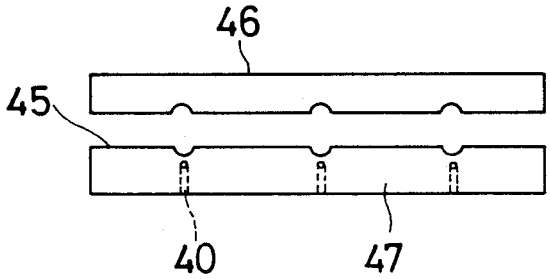
FIG. 9 is a front view of a burner shown in FIG. 1.
Figure 13:
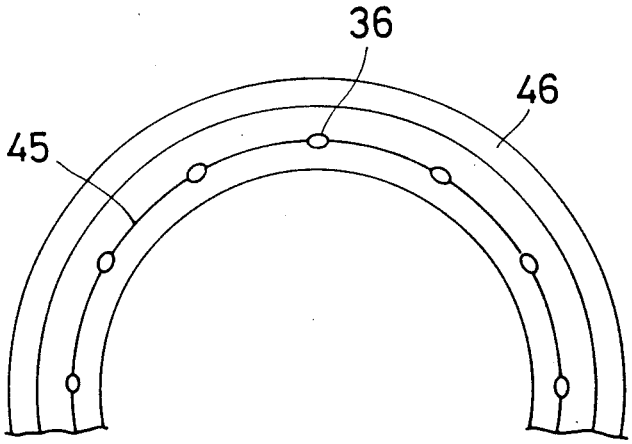
FIG. 13 is a partial plane view of a burner of a further another embodiment of a Stirling engine in accordance with the present invention.
Figure 14:
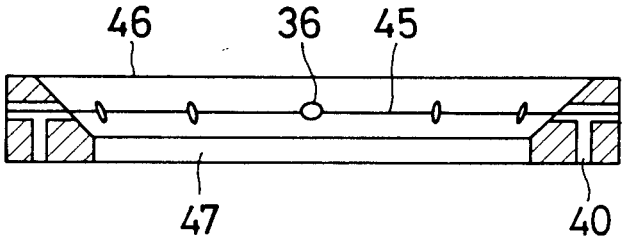
FIG. 14 is a sectional view of the burner shown in FIG. 13.

The embodiment shown by FIGS. 13 and 1 4 is substantially the same as the embodiment shown by FIGS. 6–8. In the embodiment shown by FIGS. 13 and 14, however, the fuel delivery holes 40 are connected with the air holes 36, whereby the fuel is pre-mixed in the air.

Figure 15:
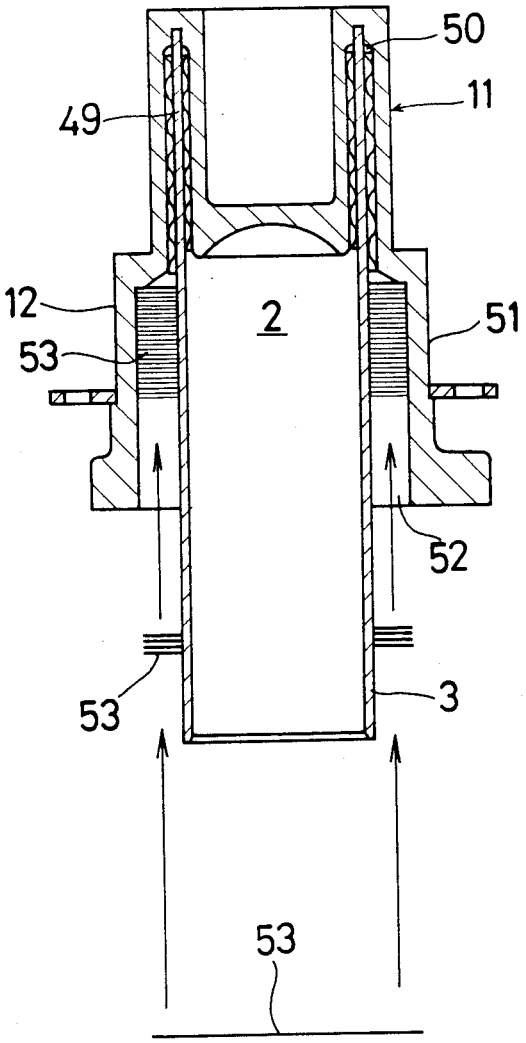
FIG. 15 is a front view of the burner shown by FIG. 13.

In FIG. 15, the expansion cylinder 3 has an extension part 49 which extends from the expansion chamber 2 to an upper side and the heater 11 is disposed so as to form an annular area 50 about the extension part 49. The heater 11 has a cylindrical shape and the annular area 50 is formed as its cylindrical wall. In the annular area 50, the extension part 49 is loosely fitted therein, and as a result, an annular passage which communicates with the regenerator 12 and an annular passage which communicates with the expansion chamber 2 are defined in the annular area 50. Thereby, the operational gas which is in the annular area 50 is received from the inner and outer circumference surfaces of the heater 11. Both annular passages are in communication with each other.

The regenerator 12 in communication with the heater 11, includes annular metal mesh members 53 which are filled in an annular area 52 which is formed when a cylindrical member 51 is disposed around the expansion cylinder 3. The metal mesh members 52 are made of stainless steel and has have a line diameter of 50–200 μm. The metal mesh members 53 are filled in the annular area 52 so as to occupy about half of the area capacity of the annular area 52.

Figure 16:
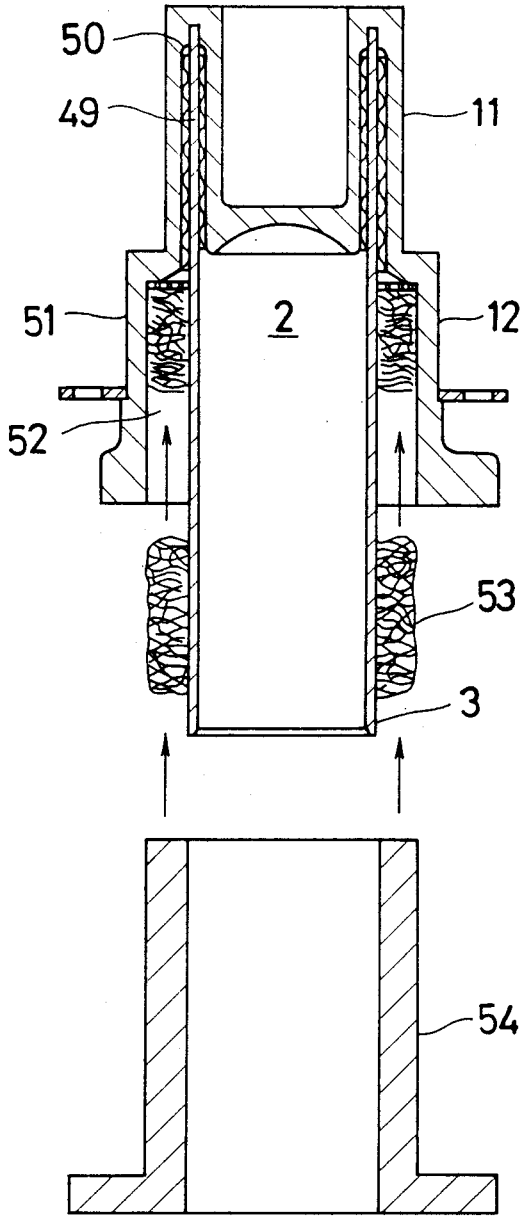
FIG. 16*a* and FIG. 16*b* are sectional views of the regenerators of other embodiments of a Stirling engine in accordance with the present invention.
Figure 16:
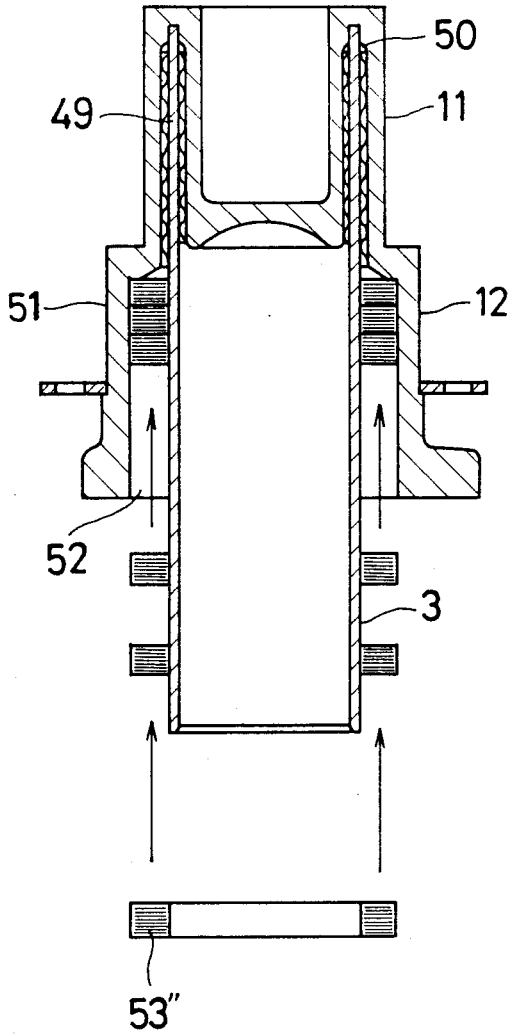

The embodiment shown in FIG. 16a is an embodiment in which a metal fiber 53' is filled in the annular area 52. The metal fiber 53' is made of stainless steel and has a line diameter of 50–200 μm. The metal fiber 53' is filled in the annular area 52 so as to occupy substantially 50% of the area capacity of the annular area 52 and is inserted therein by a mandril 54.

The embodiment shown by FIG. **16*b* is the embodiment in which preformed metal fiber 53" is filled in the annular area 52. The pre-formed metal fiber 53" is preformed so as to provide a density capacity of substantially 50% as compared with the capacity density of the unfilled area 52**.

Figure 17:
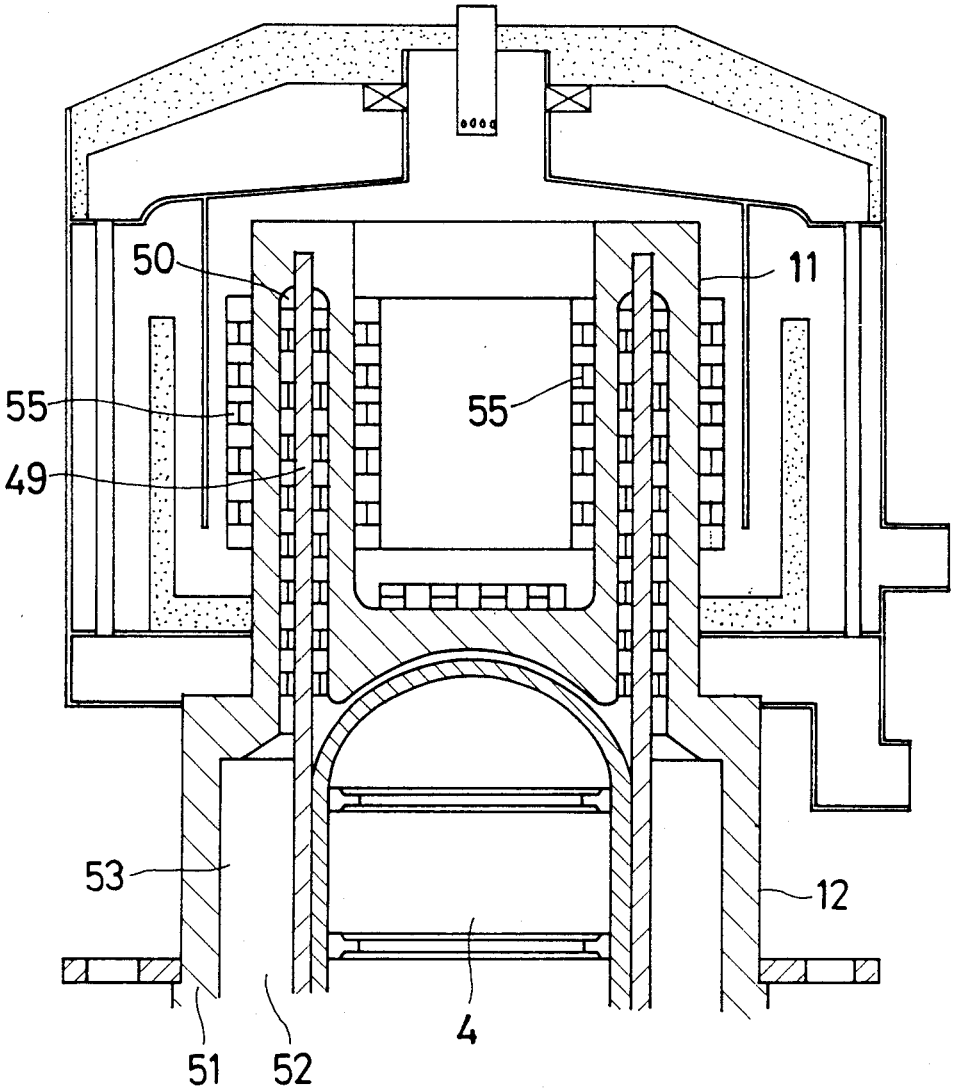
FIG. 17 is a sectional view of a heater part of an embodiment of a Stirling engine in accordance with the present invention.
Figure 18:
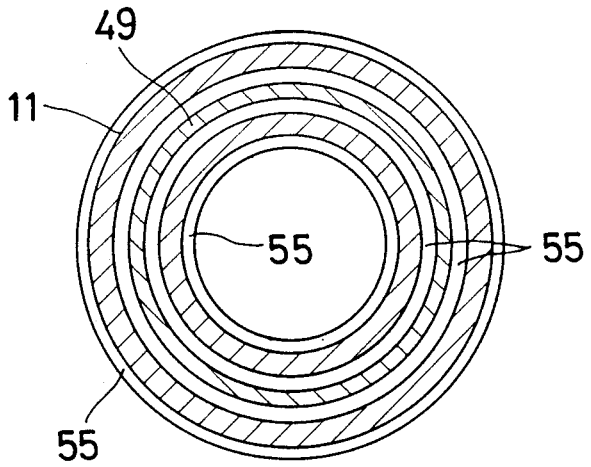
FIG. 18 is a lateral sectional view of a heater shown in FIG. 17.
Figure 19:
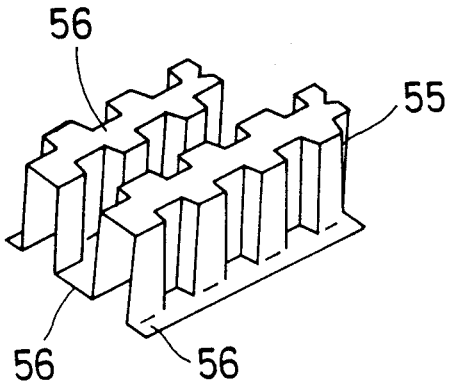
FIG. 19 is a fin of an embodiment of a Stirling engine in accordance with the present invention.

An embodiment in which fins 55 are added to the heater 11 is shown in FIG. 17. In FIG. 17, the fins 55 are disposed along the inner and outer circumference surfaces of the extension part 49 of the expansion cylinder 3 and are disposed along the inner and outer circumference surfaces of the cylindrical heater 11. Thereby, the heat transmitting area of the heater 11 is increased. The fin 55 is comprised of a multi-step type in which a zigzag unevenness is formed on stainless steel material while being in close contact and continuous, whereby the surface area is increased. The fin 5 is bonded to the extension part 49 and the inner and outer circumference surfaces of the heater 11 at the flat surface 56 of the upperside and lowerside. Thereby, the operational gas and the combustion gas flow along the curved passage formed by the unevenness of the fins and transfer the heat. Also, the heater 11 can be reinforced by the fins 55. The fins 55 can be used with the preheater 15 shown in FIG. 1. In such a case, the fins 55 are cylindrically disposed in the cylindrical passage which directs the air for the combustion and the cylindrical passage passing the combustion gas.

The buffer chamber 26 is in communication with the crank chamber 25 via passages 56, 57. The passages 56, 57 are formed at a position difficult for the oil to invade. Thereby, in this embodiment, the contamination of the operational gas is prevented. The oil filter 29 is positioned below the oil level in the crank chamber 25. Thereby, the oil is easily able to pass the oil filter 29 by the absorptivity of the oil pump 32.

Figure 20:
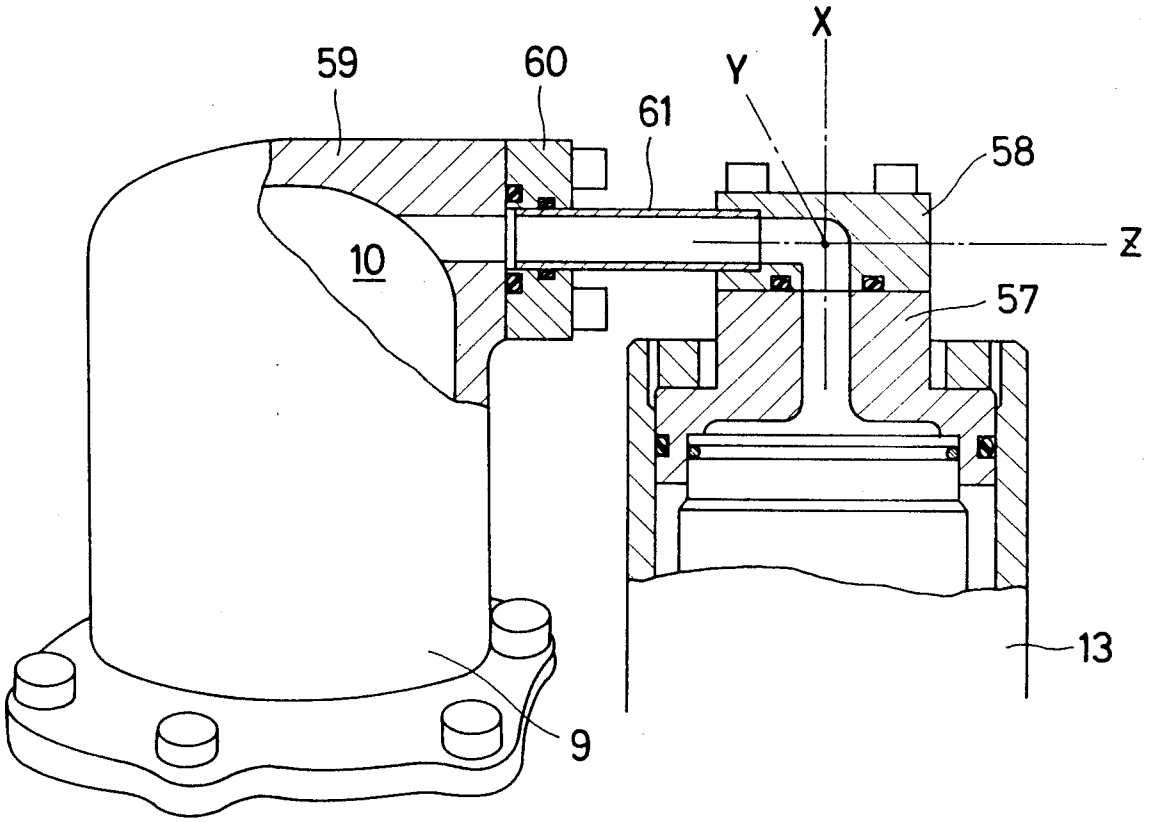
FIG. 20 is a structure for communicating between a cooler and a compression chamber of an embodiment of a Stirling engine in accordance with the present invention.

The operational center of the expansion piston 4 is offset 45 degrees with regard to the operational center of the compression piston 8 as shown by FIG. 1. Therefore, the structure for connecting the compression chamber 10 with the cooler 13 necessitates the three-dimensional arrangement. In FIG. 20, a first flange 58 is fixed to a head 57 of the cooler 13 by bolts via an opening formed in the first flange 58. Thereby, the position can be adjusted in the Y direction. A second flange 60 is fixed to a head 59 of the compression cylinder 9 by bolts via an opening formed in the second flange 60. Thereby, the position can be adjusted in the X direction. The first flange 58 is connected with the second flange 60 via a pipe 61. One end of the pipe 61 is welded in the passage formed in the first flange 58 and the other end of the pipe 61 is slidably fitted into the passage formed in the second flange 60 via an O ring. Therefore, it can be adjusted in the Z direction by the relative movement between the pipe 61 and the second flange 60.

As mentioned above, according to the present invention, the heater can be made smaller, the number of parts is decreased and the number of brazing and welding points is decreased by cylindrical structure so as to improve the manufacturing process.

Furthermore, it is not necessary to form the manifold for dividing the operational gas paths as in the multipipe type. Therefore, improvement of the performance of the uniformity of the flow of the operational gas is obtained.

The principles, preferred embodiments and modes of operation of the present invention have been described in the foregoing application. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A Stirling engine comprising:

an expansion chamber defined in an expansion cylinder by an expansion piston;

a compression chamber defined in a compression cylinder by a compression piston and communicating with the compression chamber via a heater, a regenerator and a cooler;

the heater including an extended part of the expansion cylinder which extends from the expansion chamber toward an upper side and a hollow cylindrical member having a bottom and an annular area which receives the extended part therein;

an annular passage formed between an inner and an outer circumference of the extended part and an inner wall surface of the annular area; and a heat transfer fin arrangement provided on the inner and the outer surface of the extended part of the expansion cylinder.

2. A Stirling engine as recited in claim 1, wherein the fin is formed on an inner and an outer surface of the hollow cylindrical member.

3. A Stirling engine as recited in claim 1 wherein the fin has a continuous zigzag unevenness.

4. A Stirling engine as recited in claim 2 wherein the fin has a continuous zigzag unevenness.

* * * * *